US011547208B2

(12) United States Patent
Bennett

(10) Patent No.: US 11,547,208 B2
(45) Date of Patent: Jan. 10, 2023

(54) SCORING OR BEVERAGE STATION FOR A TOSS GAME

(71) Applicant: Matthew G Bennett, New Berlin, WI (US)

(72) Inventor: Matthew G Bennett, New Berlin, WI (US)

( * ) Notice: Subject to any disclaimer, the term of this patent is extended or adjusted under 35 U.S.C. 154(b) by 978 days.

(21) Appl. No.: 16/292,437

(22) Filed: Mar. 5, 2019

(65) Prior Publication Data

US 2019/0313787 A1 Oct. 17, 2019

Related U.S. Application Data

(60) Provisional application No. 62/657,588, filed on Apr. 13, 2018.

(51) Int. Cl.

| | |
|---|---|
| ***A47B 37/00*** | (2006.01) |
| ***A63B 71/06*** | (2006.01) |
| ***A47B 13/16*** | (2006.01) |
| ***A47B 3/06*** | (2006.01) |

(52) U.S. Cl.

CPC ..... *A47B 37/00* (2013.01); *A47B 3/06* (2013.01); *A47B 13/16* (2013.01); *A63B 71/06* (2013.01); *A47B 2220/0077* (2013.01); *A63B 2071/0602* (2013.01)

(58) Field of Classification Search

CPC ..... A47B 37/00; A47B 3/06; A47B 13/16; A47B 2220/0077; A63B 71/06; A63B 2071/0602; A63B 71/0608; A63B 71/0619; A63B 71/0669; A63B 71/0672; A63B 71/0695; A63B 67/06; F16M 11/04; F16M 13/02; A63F 11/0051; A63F 11/0053; A63F 11/0055; A63F 11/0058

USPC ..... 116/225; 248/122.1, 125.1, 227.3; 108/23, 50.12, 157.1, 159.11, 158.11, 108/158.13, 42; 211/133.1, 88.01

See application file for complete search history.

(56) References Cited

U.S. PATENT DOCUMENTS

| | | | | |
|---|---|---|---|---|
| 1,824,813 A * | 9/1931 | Friedemann | ..... | A47F 5/04 248/125.3 |
| 2,512,197 A | 6/1950 | Cusano | | |
| 2,513,623 A | 7/1950 | Bray | | |
| 4,634,090 A * | 1/1987 | Currie | ..... | G10H 1/32 984/344 |

(Continued)

FOREIGN PATENT DOCUMENTS

| | | |
|---|---|---|
| CN | 205625154 | * 10/2016 |
| DE | 102018114659 | * 12/2019 |

*Primary Examiner* — Janet M Wilkens
(74) *Attorney, Agent, or Firm* — Lawrence Pope

(57) ABSTRACT

A multicomponent modular kit for assembling a scoring station for a toss game includes an upright member, a scoreboard adapted to be repeatedly removably affixed to the upright member, a shelf structure adapted to be repeatedly removably affixed to the upright member and to hold cylindrical beverage containers and a base adapted to be repeatedly removably affixed to the lower section of the upright member to stably hold it in a vertical orientation when the scoreboard and shelf structure are affixed to the upright member and the base is placed on a hard essentially horizontal surface. A multicomponent modular kit for assembling a beverage station has the same components as the scoring station except that it may omit the scoreboard.

17 Claims, 16 Drawing Sheets

(56) References Cited

U.S. PATENT DOCUMENTS 4,865,283 A * 9/1989 Parker ..... A47F 5/04 211/205
5,022,626 A * 6/1991 Nozel ..... B60R 11/00 248/311.2
5,025,748 A 6/1991 Pettis
5,040,307 A 8/1991 Dotson
5,690,307 A * 11/1997 Joyce ..... F16M 11/40 248/205.2
5,878,672 A * 3/1999 Ostermann ..... B60N 3/004 297/188.06
D416,947 S 11/1999 Coutu
5,996,511 A * 12/1999 Swoger ..... A47B 57/26 108/151
6,748,874 B2 * 6/2004 Gawronski ..... A47B 23/025 108/42
6,889,618 B1 * 5/2005 Gromack ..... A47B 13/088 108/151
D518,390 S 4/2006 Poffenberger
D579,352 S 10/2008 Brodie
7,506,852 B1 * 3/2009 Towfigh ..... A47B 57/04 108/151
7,527,600 B2 * 5/2009 Farmer ..... F16B 9/058 403/93
D596,961 S 7/2009 Moran et al.
7,607,666 B1 7/2009 Studier
D644,131 S 8/2011 Karu
8,015,929 B2 * 9/2011 Tyner ..... F16M 11/24 108/42
8,033,679 B1 * 10/2011 Kemmler ..... A47B 97/00 211/90.01
8,136,458 B1 * 3/2012 Cass ..... D06F 53/005 108/42
8,201,794 B1 * 6/2012 Pesola ..... A45F 3/44 248/312.1
8,381,662 B2 * 2/2013 Goldszer ..... A47B 37/04 135/16
D692,132 S * 10/2013 Damron ..... D24/128
8,578,875 B1 11/2013 Alexander
D711,256 S 8/2014 Todd, III
8,807,064 B2 8/2014 Chui-Ching
8,807,569 B1 8/2014 Davis
9,067,120 B2 * 6/2015 Huang ..... A63B 71/0672
D846,756 S * 4/2019 Lacy ..... D24/231
D886,646 S * 6/2020 Bennett ..... D10/46.1
11,094,304 B2 * 8/2021 Klein ..... G10G 7/00
11,103,765 B2 * 8/2021 Wehrs ..... A63B 71/0672
2007/0267551 A1 * 11/2007 Townsend ..... A61M 5/1415 248/311.2
2008/0178777 A1 * 7/2008 Tyner ..... F16M 11/24 108/117
2009/0051133 A1 2/2009 Oshiro
2010/0050926 A1 3/2010 Volack
2011/0215528 A1 * 9/2011 Conville ..... A63B 67/06 273/402
2014/0070061 A1 * 3/2014 Tsai ..... A47D 1/008 108/25
2015/0054221 A1 2/2015 Sandman et al.
2015/0216602 A1 * 8/2015 Brotzman ..... A61B 50/15 108/106
2021/0101059 A1 * 4/2021 Hudak ..... A63B 71/023
2021/0331059 A1 * 10/2021 Butler, Jr. ..... A63B 67/06
2021/0379468 A1 * 12/2021 Merkel ..... A63B 71/06
2021/0387074 A1 * 12/2021 Wehrs ..... A63B 71/0672

* cited by examiner

SCORING OR BEVERAGE STATION FOR A TOSS GAME

BACKGROUND OF THE INVENTION

Toss games which involve two scoring sites separated by a considerable distance which challenges the skill of the players such as corn hole, also known as bags, washers and horse shoes are quite popular. Formal leagues have been formed which sponsor extensive tournaments, although these games are also popular for family and neighborhood gatherings. Typically the players simply keep the score in their heads, place any beverages they might be consuming while playing on the ground and recover all the playing pieces from the vicinity of a scoring site after they have been played by the players located at the other scoring site. These toss games usually involve multiple playing pieces that are tossed in rounds or turns by multiple players. This typically means a player has no convenient place to put the playing pieces other than the one he is immediately going play and this may result in a player holding these excess pieces in his non-playing hand while awaiting or taking his turn. Thus it would enhance the playing experience if there were a display of the score, a place at a convenient height to put any beverages being consumed and a convenient place to put the playing pieces until they are put into play. However, these toss games are frequently played at non-permanent sites which means all the apparatus used with theses games should be readily transportable and it is desirable if some or all of the involved pieces can be put in easily to carry containers. In addition if any of the involved pieces need to be assembled, perhaps to facilitate their transport, it is desirable that such assembly not require any tools or strenuous effort. In addition, because these games are a pastime it's not unusual for them to be played in the evening when there might be a need for illumination,

SUMMARY OF THE INVENTION

The present invention involves a multicomponent modular kit for assembling a scoring station for a toss game. It comprises an upright member comprising an upper section and a lower section adapted to be repeatedly removably rigidly joined to each other at a terminal end of each, a scoreboard adapted to be repeatedly removably affixed to the upright member, a shelf structure adapted to be repeatedly removably affixed to the upright member and to hold cylindrical beverage containers, and a base adapted to be repeatedly removably affixed to the lower section of the upright member to stably hold it in a vertical orientation when the scoreboard and shelf structure are affixed to the upright member and the base is placed on a hard essentially horizontal surface.

The present invention further involves a multicomponent modular kit for assembling a beverage station for a toss game. It comprises an upright member, a shelf structure adapted to be repeatedly removably affixed to the upright member and to hold cylindrical beverage containers, and a base adapted to be repeatedly removably affixed to the upright member to stably hold it in a vertical orientation when the scoreboard and shelf structure are affixed to the upright member and the base is placed on a hard essentially horizontal surface, the base having leveling means to facilitate keeping the upright member in a vertical orientation when it is placed on a less than entirely horizontal surface. The upright member may be provided in different heights. For instance it may be adapted to just support the shelf structure at a convenient height for accessing a beverage. On the other hand, it may have a sufficient height to accommodate a scoreboard. If this unitary upright member is provided with means to removably attach a scoreboard and the modular kit is also provided with a scoreboard that may be repeatedly removably affixed to the upright member, the beverage station would substantially overlap the scoring station.

DETAILED DESCRIPTION

Figure 1:
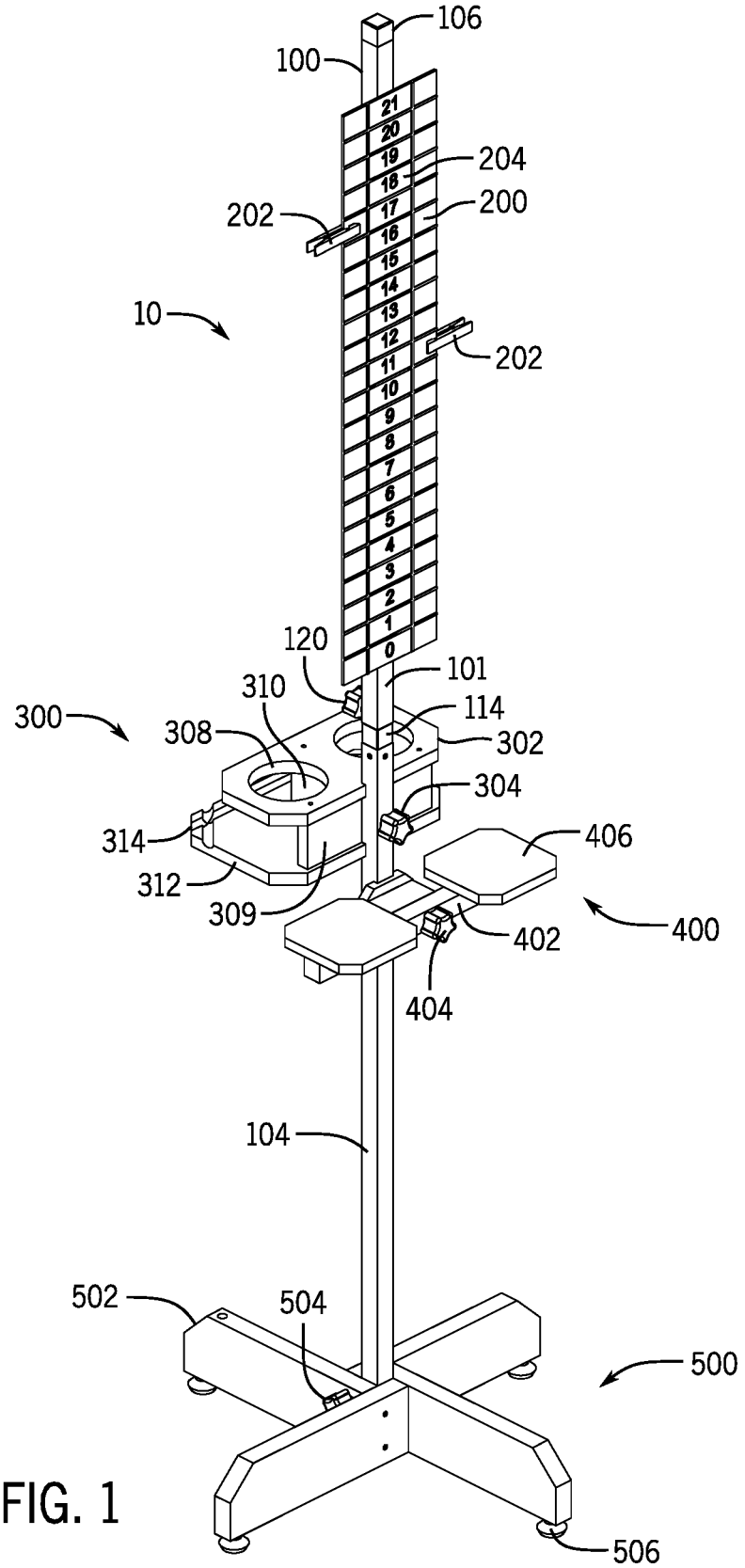
FIG. 1 is a perspective view of a scoring station for use with a toss game showing its upright member, scoreboard, beverage shelf structure, storage structure and base.

FIG. 1 is an illustration of a scoring station 10 suitable for use with a toss game such as corn hole or bags, washers or horseshoes. It has an upright member 100 which has an upper section 101 and a lower section 104. They are conveniently hollow tubes, such as 1 inch square aluminum tubing with a 1/16 inch wall. This provides a flat surface to which a scoreboard 200 can be affixed. The open top of the upper section 101 is closed with an upper section cap 106. The two sections 101 and 104 are joined by a connector 114 that has a connector knob 120 that can be tightened to securely capture the upper section 101. Each of the sections 101 and 104 may conveniently be about 3 foot in length. The two sections 101 and 104 may be conveniently colored a desirable color such as black by powder coating. A scoreboard 200 is removably affixed to the upper section 101 and carries movable score indicators 202 which interact with score indicia 204. The score indicators may conveniently be colored clothespins with each clothes pin 202 having a different color than the other clothes pin 202. The two indicators may each be a different color to aid in recognizing the score of each team when two teams are using the scoring station 10 to track their scores. The scoreboard 200 may be a 30 inch tall by 6 inch wide ⅛ inch thick sheet of corrugated plastic such as Coroplast. A beverage shelf structure 300 is removably attached to the lower section 104 by the beverage shelf structure knob 304. The structure 300 has an upper shelf 302 and a lower shelf 312 which are attached to each other by the shelf structure back 309 and the shelf structure separator 310. The upper shelf 302 has beverage apertures 308 which are cylindrical and adapted to interact with common beverage containers such as beer or soda bottles or common drinking glasses. These apertures may conveniently have diameters in the range of 3⅝ inches. The lower shelf 312 has a groove 314 that has a profile which mates with the edge of a typical cell phone or smart phone such as an iPhone. Both of the shelves 302 and 312 may conveniently be about 11 inches wide with the upper shelf 302 projecting about 5½ inches from the lower section 104 and the lower shelf 312 projecting 7½ inches from the lower section 104. The shelf structure back 309 and the shelf structure separator 310 are both conveniently about 2½ inches in height. This is intended to provide a deep enough well to securely retain common beverage containers or drinking glasses and to provide a sufficient angle between the front edge of the upper shelf 302 and the groove 314 to allow a smart phone to securely lean against the front edge of the upper shelf 302 with its face visible to players using the scoring station. The shelf structure 300 is conveniently constructed of high density polyethylene (HDPE). The HDPE may be supplied in a desirable color such as black. A storage structure 400 is removably attached to the lower section 104 by the storage structure knob 404 via the storage structure rod 402 and the storage structure bracket 408 (Shown in FIG. 4). The storage structure rod 402 holds two storage structure pads 406 in a horizontal orientation. These pads 406 may conveniently be used to hold the small bean or sand bags used in the toss game called corn hole or bags. They may also be used as illustrated to retain metal washers for the toss game known as washers or the pads 406 may be adapted to better accommodate the washers by, for instance, each being provided with an upright post to pass through the center of the washers. The pads 406 may conveniently have sides in the range of 5 inches and be constructed of HDPE that may be colored black while the rod 402 may be the same 1 inch square 1/16 inch wall black powder coated aluminum tubing as the upright member 100. The pads 406 may be conveniently placed on the rod 402 such that the total distance from the outside edge of one pad 406 to the outside edge of the other pad 406 is in the range of 14 inches thus providing a spacing between the inside edges of the pads 406 in the range of 4 inches. A base 500 is removably attached to the upright member 100 and stably supports the whole scoring station 10 including the scoreboard 200, the beverage shelf structure 300 and the storage structure 400 when it is disposed on a rigid essentially horizontal surface. The base 500 is formed of four legs 502 disposed at 90° to each other and is secured to the lower section of the upright member 104 by a base knob 504. The legs may conveniently each have a length in the range of 11½ inches. The legs 502 each have a leveling foot 506 which can be adjusted to accommodate surfaces that are less than entirely horizontal. The leveling feet 506 may be conveniently attached to the legs 502 by threaded shafts that allow adjustment in the range of about 1½ inches. The base 500 may conveniently be constructed of HDPE like the beverage shelf structure 300 and the pads 406 of the storage structure 400. The base 500 may, of course, have other configurations as long as it provides the needed stability for keeping the scoring station 10 vertical. It is anticipated that the scoring station 10 may be used on a rigid or hard generally non-penetrable horizontal surface such as a driveway, patio or an interior floor and thus its base 500 should resist tipping when deployed on such a surface. The base 500 should, unaided, provide stability under the conditions typically encountered when people engage in outdoor toss games. However, in high winds or when there is a significant risk that the scoring station may be bumped or jostled, such as at a crowded tournament, it may be advantageous to take additional measures such as placing a weight on one of the legs 502, particularly when the scoring station 10 is coupled with an illumination source as discussed in connection with FIG. 11-14.

The materials of construction of the scoring station 10 should conveniently give it good weatherability. It is anticipated that the scoring station 10 will mainly be used outdoor where it will be exposed to the elements. The use of aluminum and HDPE as the materials of construction are helpful in imparting weatherability.

Figure 1A:
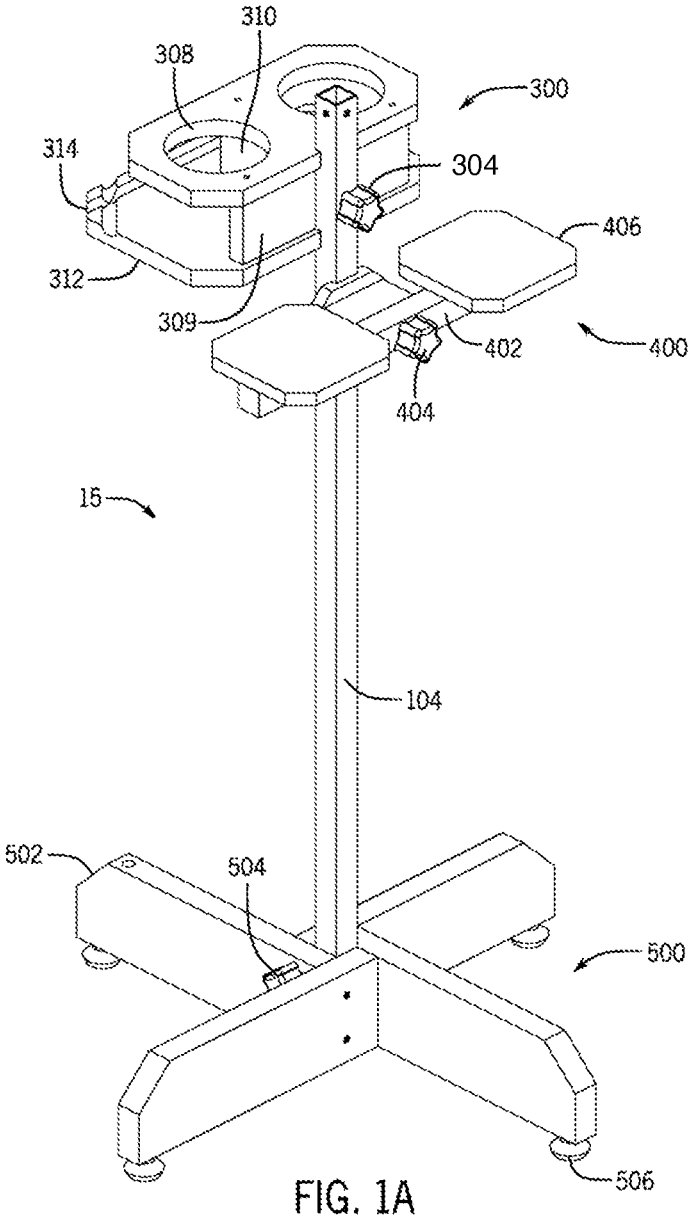
FIG. 1A is a perspective view of a beverage station for use with a toss game showing its upright member, beverage shelf structure, storage structure and base.

FIG. 1A is an illustration of a beverage station 15 suitable for use with a toss game such as corn hole or bags, washers or horseshoes. It has many of the same components as the scoring station 10 illustrated in FIG. 1. However, it omits all of the components that appear above the lower section 104 of the upright member 100. Thus it has the beverage shelf structure 300, the storage structure 400 and the base 500, but it omits the upper section 101, the scoreboard 200 and the connector 114. It does however have a cap 106 (Not shown) that mates with the top of the lower section 104 in a manner similar to the way cap 106 mates with the top of upper section 101 (As shown in FIG. 1). It is contemplated as a useful companion to the scoring station 10. In the typical toss game, such as corn hole, there are two scoring sites separate by a substantial distance in order to provide a challenge to the players scoring points. The concept of simultaneously using both the scoring station 10 and the beverage station 15 is to place one at one of the scoring sites and the other at the other scoring site. The beverage station 15 may be conveniently modified by attaching the connector 114 to the top of the lower section 104 and then adding all the other features of the of the scoring station 10 with the exception of the scoreboard 200. Then a light source like one of those illustrated in FIG. 11-14 can be conveniently affixed to the top of the upper section 101 in a repeatedly removable manner. In such a case, the upper section 101 would not carry the pads 113 (Shown in FIG. 6). Such a modified beverage station could then be used with a scoring station 10 which also had a light source to provide illumination at both scoring sites of a toss game when the game is played under limited light circumstances.

Figure 2:
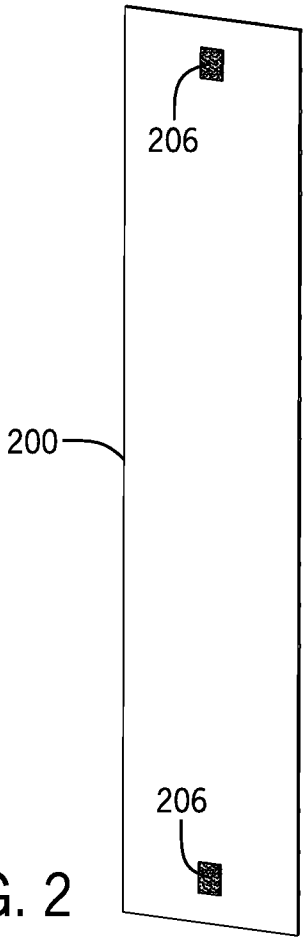
FIG. 2 is a rear elevation of the scoreboard.

FIG. 2 is an illustration of some features of the scoreboard 200. On the rear surface of the scoreboard 200 are two pads 206, which are each part of a reclosable fastener set that mates with a corresponding pad 113 (Shown in FIG. 6) of the upper section 101 of the upright member 100. The pads 113 and 206 are conveniently each part of a reclosable fastener set with an interlocking mushroom-shaped head design sold under the Dual Lock name. The use of a reclosable fastener set facilitates the assembly and disassembly of the scoring station 10 from and to its component parts.

Figure 3:
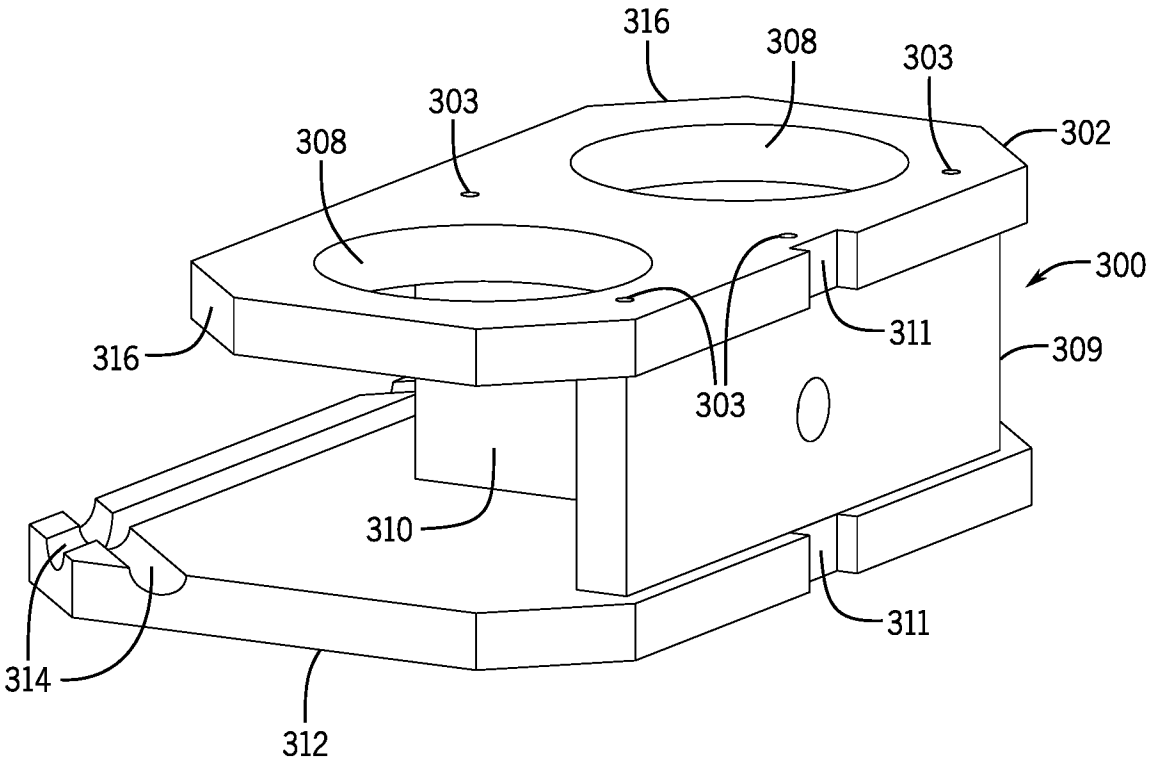
FIG. 3 is perspective view of the beverage shelf structure.

FIG. 3 is an illustration of some of the features of the beverage shelf structure 300. The shelf structure 300 has an upper shelf 302 joined to a lower shelf 312 by a back 309 and a separator 310. The upper shelf 302 is affixed to the back 309 and the separator 310 by screws 303 that pass directly into the back 309 and the separator 310. Because the shelf structure 300 is not intended to be disassembled by the end user and because the back 309 and the separator 310 present substantial material to the screws 303 threaded inserts are not employed thus reducing the cost and effort of the initial construction. The lower shelf is similarly affixed to the back 309 and the separator 310 by screws that pass through the lower shelf 312 and directly into the back 309 and the separator 310 (These screws not shown). The upper shelf 302 is provided with apertures 308 to accommodate generally cylindrical shaped beverage holders such as beer or soda bottles or cans or drinking glasses. The lower shelf 312 is provided with a groove 314 that has a width sufficient to accommodate the edge of a common cell or smart phone such as an iPhone. The horizontal dimensions of the upper shelf 302 are sufficiently smaller than those of the lower shelf 312 that a common cell or smart phone with its edge placed in the groove 314 can be stably leaned against one of the edges 316 of the upper shelf. The shelf structure 300 has a channel 311 that is formed in both the upper shelf 302 and the lower shelf 312 to accommodate the lower section 104 (Shown in FIG. 1) of the upright member 100. The back 309 and the separator 310 are provided with a threaded insert 307 (Shown in FIG. 3A) that interacts with the threaded shaft 306 of the shelf structure knob 304 (Both shown in FIG. 10). The threaded insert 307 is provided to accommodate repeated assembly and disassembly of the components that make up the kit for either the scoring station 10 or the beverage station 15. All four elements of the beverage shelf structure can be conveniently constructed of HDPE that may conveniently be colored black.

Figure 3A:
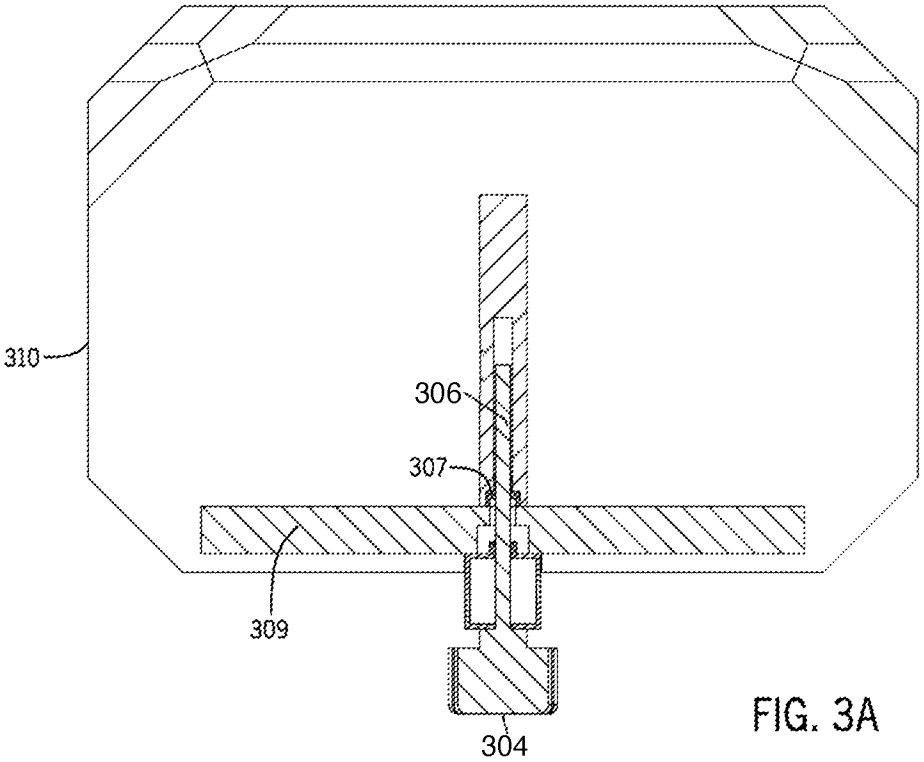
FIG. 3A is a cross-section of a portion of the beverage shelf structure.

FIG. 3A is a cross-section of the back 309 and the separator 310 in which the threaded insert 307 is more clearly visible. It shows the threaded insert 307 anchored in the separator 310 with a passage being provided through the back 309 to accommodate the shaft 306 of the knob 304 (Both shown in FIG. 10) which threads into the threaded insert 307 to secure the beverage shelf structure 300 to the lower section 104 (Also shown in FIG. 10) of the upright member 100.

Figure 4:
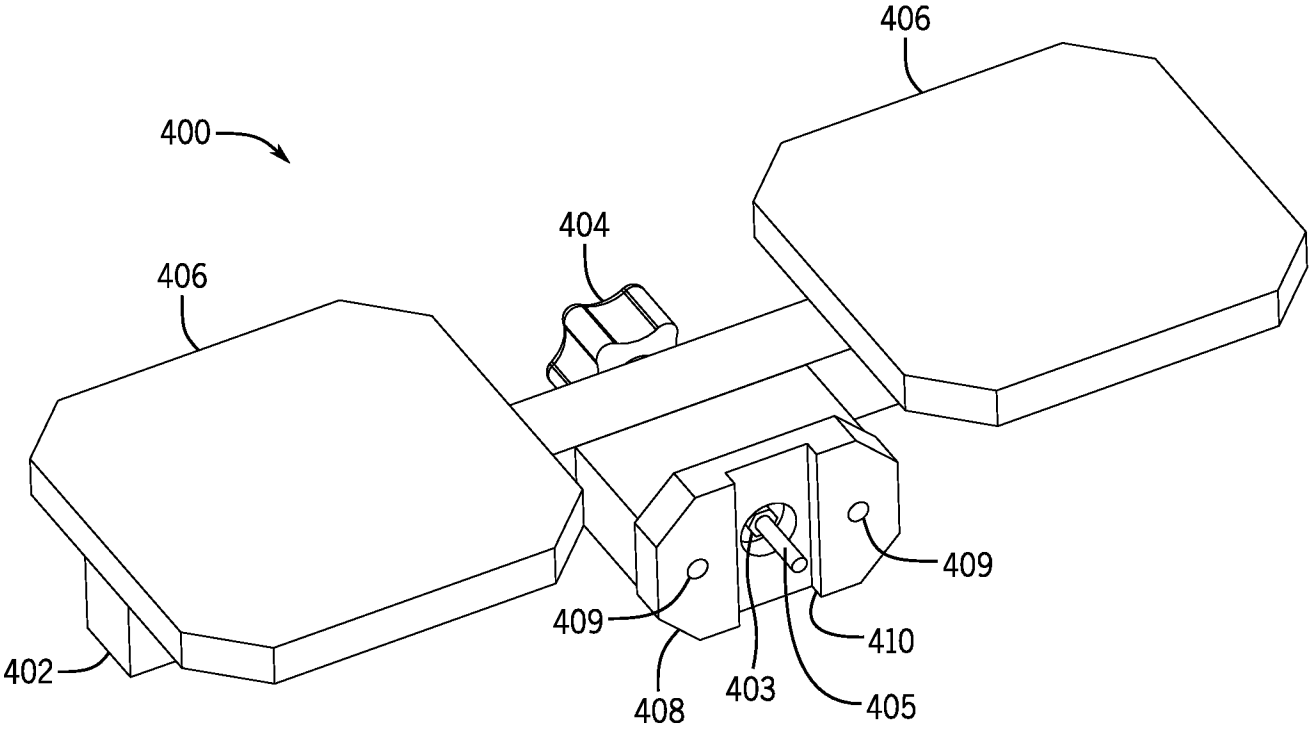
FIG. 4 is a perspective view of the storage structure.

FIG. 4 is an illustration of some of the features of the storage structure 400. It has a rod 402 to which two pads 406 are secured. It is removably affixed to the lower section 104 by the interaction of its knob 404 and its threaded shaft 405 with the rivet nut 132 of the lower section 104 (Both shown in FIG. 10). The threaded shaft 405 carries a nylon lock washer 403 that prevents the knob 404 from disengaging from the storage structure 400 and potentially becoming lost when the knob 404 is rotated to disengage from the rivet nut 132. A bracket 408 is secured to the rod 402 by screws 409 and the bracket 408 has a channel 410 that mates with the lower section 104. The pads 406 and the bracket 408 are conveniently constructed of HDPE that may conveniently be colored black. The nylon lock washer 403 may be replaced by any convenient retention device that allows the threaded shaft 405 to rotate but prevents the knob 404 from disengaging from the storage structure 400.

Figure 5:
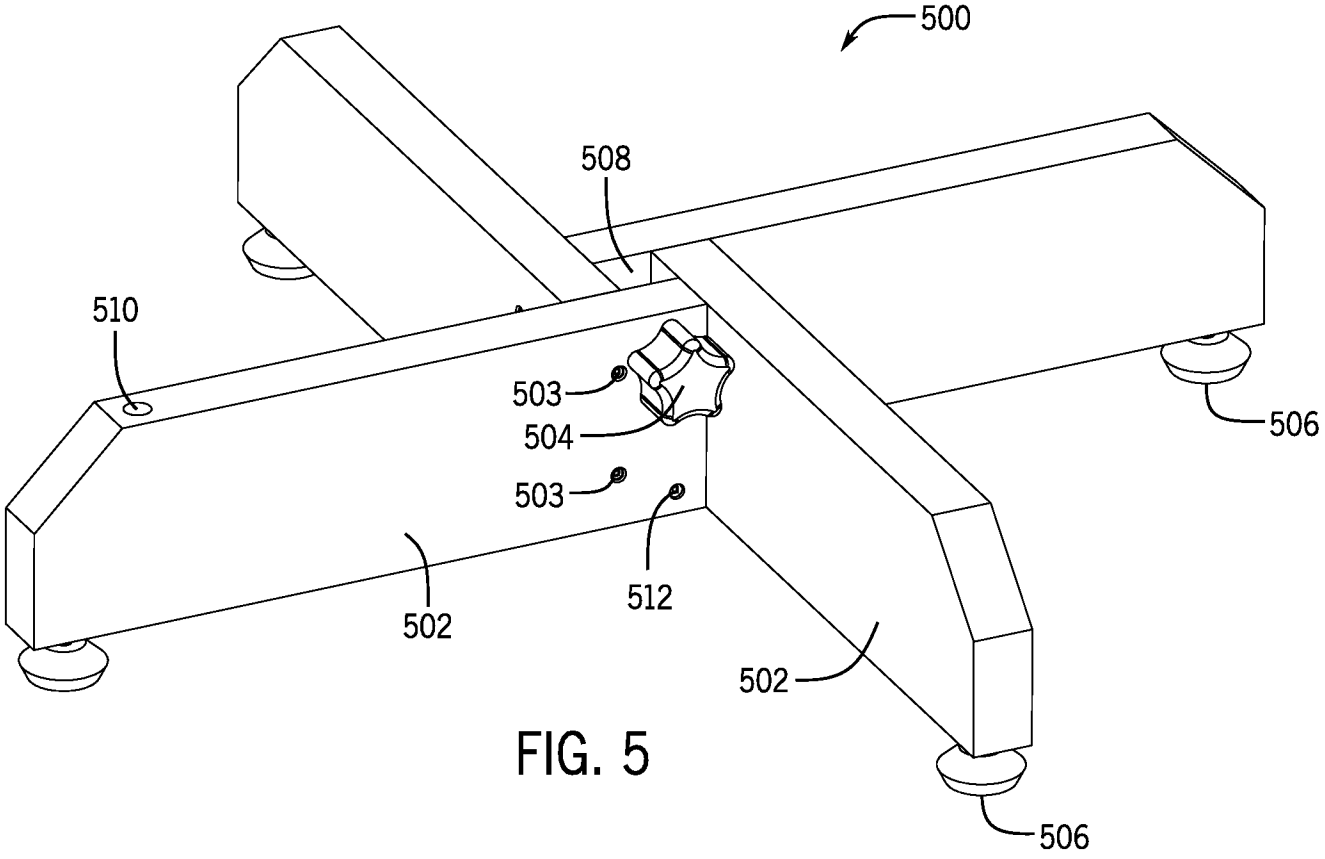
FIG. 5 is a perspective view of the base.

FIG. 5 is an illustration of some of the features of the base 500. It is formed by four legs 502 that are joined to each other at right angles by screws 503 to form a central aperture or well 508 to accommodate the bottom of the lower section 104 of the upright member 100 (Both shown in FIG. 1). Because it is not intended that the base will be disassembled after construction it is convenient from a cost and effort of construction point of view to have the screws 503 thread directly into the HDPE of the legs 502. One of the legs 502 is provided with a screw 512 which projects into the aperture or well 508 to interact with the bottom edge 134 of the lower section 104 (Both shown in FIG. 10) to stop the downward progress of the lower section 104 when it is placed in the well 508. A knob 504 is provided to advance a threaded shaft through a threaded insert in a leg 502 into the well 508 and engage a wall of the lower section 104 thus frictionally affixing the base 500 to the lower section 104. Each leg 502 is provided with a leveling foot 506 that is affixed to its leg 502 by a threaded shaft 507 that engages a threaded insert 511 (Both shown in FIG. 5A) within its leg 502. By advancing the leveling feet 506 appropriate amounts the base 500 can accommodate hard surfaces that are not entirely horizontal such that the lower section 104 is kept in a truly vertical orientation. Thus the scoring station 10 or the beverage station 15 can be deployed on hard surfaces that are not fully horizontal. One of the legs 502 is provided with a spike hole 510 to facilitate securing the base 500 when deployed on a soft readily penetrably surface such as a lawn or outdoor field. A spike can then be passed through the spike hole 510 to secure the scoring station 10 or the beverage station 15 from tipping. The base 500 can be conveniently constructed of HDPE that can conveniently be colored black. As in the case of the beverage shelf structure 300 those elements intended to be permanently secured to each other can be directly secured by screws penetrating into the HDPE, while those elements intended to be frequently rotated such as the leveling feet 506 and the securing knob 504 utilize threaded inserts.

Figure 5A:
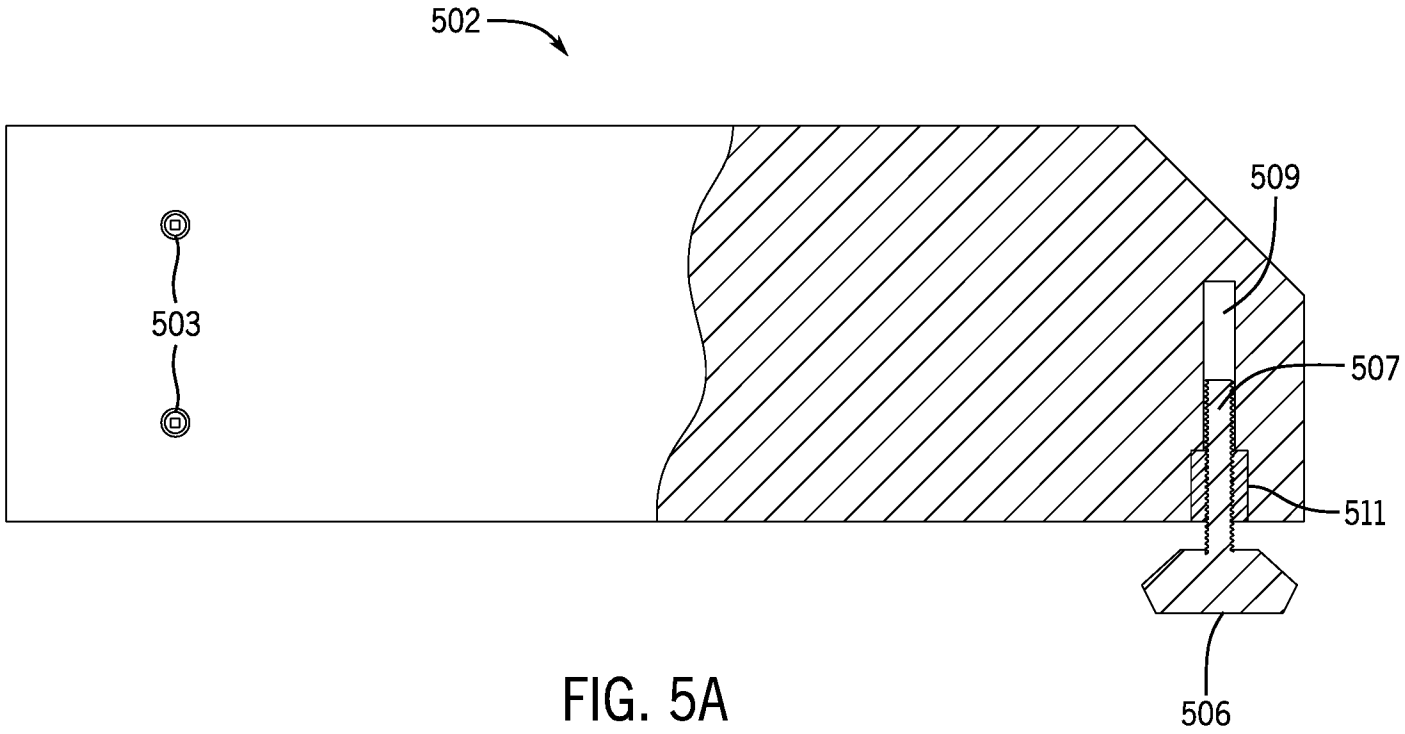
FIG. 5A is a transparent side elevation of a leg of the base.

FIG. 5A is an illustration of the operation of a leveling foot 506. Its threaded shaft 507 interacts with its threaded insert 511 to facilitate advancing or retracting the leveling foot 506 as appropriate to keep the scoring station 10 (Shown in FIG. 1) or the beverage station 15 (Shown in FIG. 1A) in a vertical orientation. The passage 509 accommodates the portion of the threaded shaft 507 that extends above the threaded insert 507. The use of the threaded inserts 511 facilitates the robust adjustment of the leveling feet 506 without undue wear on the HDPE of which the legs 502 are conveniently constructed.

Figure 6:
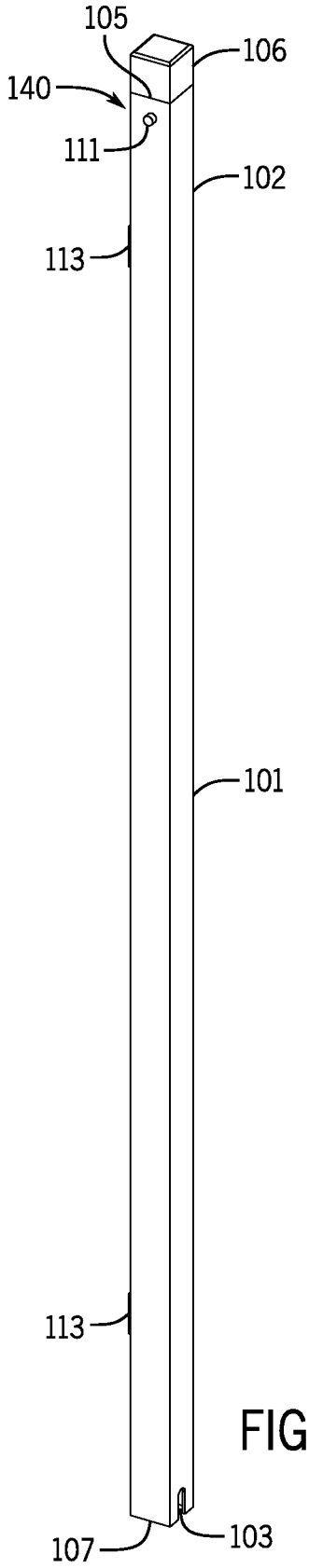
FIG. 6 is a perspective view of the upper portion of the upright member with its top cap.
Figure 7:
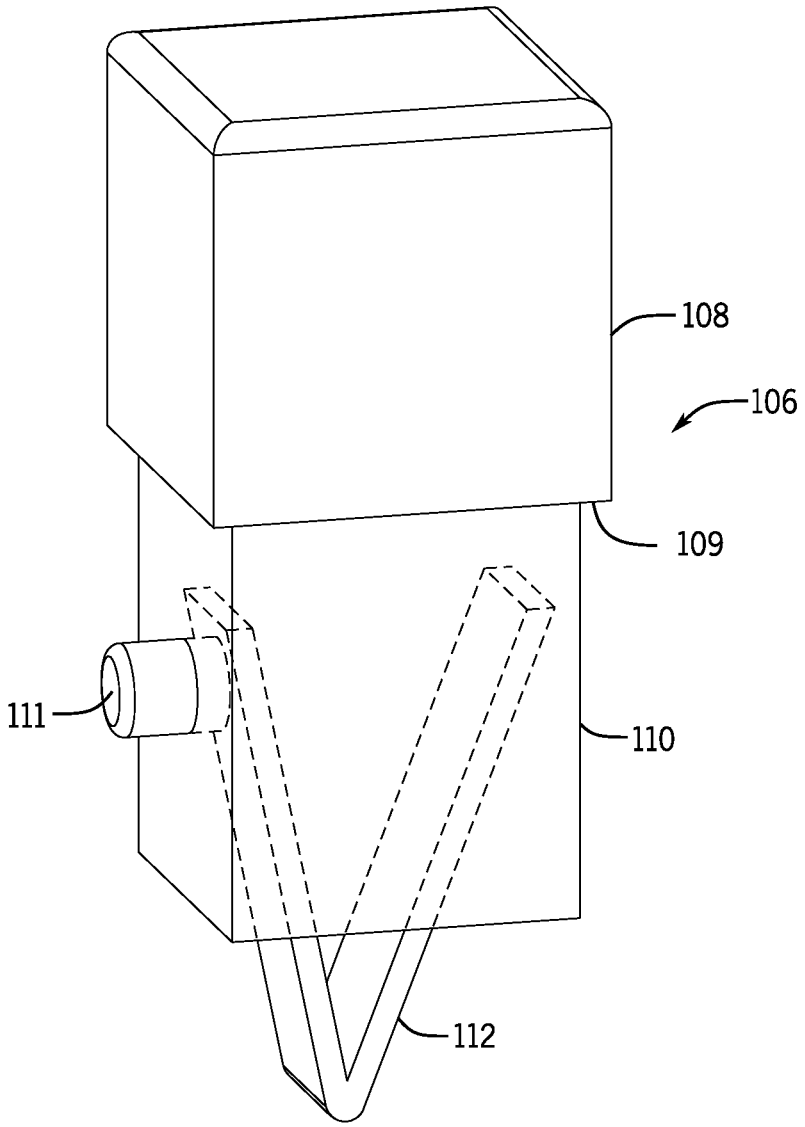
FIG. 7 is a perspective view of the top cap of the upright member of either the scoring station or the beverage station.
Figure 8:
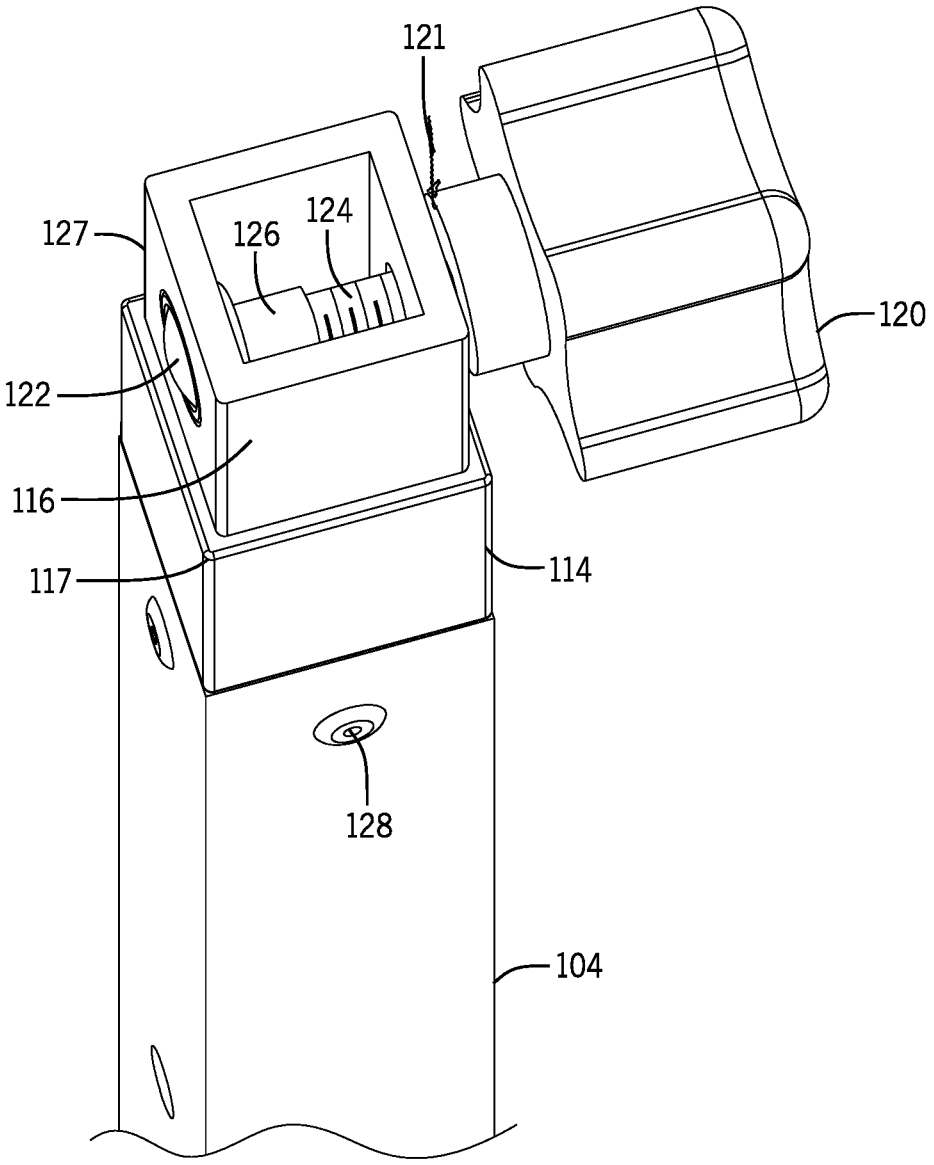
FIG. 8 is a prospective view of a connector that connects two portions of the upright member of the scoring station affixed to the bottom section of the upright member by rivets.

FIG. 6 is an illustration of some of the features of the upper section 101 of the upright member 100. The open end of the top 101 of the upper section 101 is closed off by the upright cap member 106 that is removably attached via the snap button 111. The top edge 105 of the upper section 101 mates with the step 109 of cap 106 that is shown in FIG. 7. The top 101 is provided with an aperture 140 to accommodate the snap button 111. This construction allows the top 102 of the upper section 101 to be used as a connection point for other features such as illumination sources. The bottom of the upper section 101 is provided with a slot 103 that interacts with shaft 124 of the connector knob 120 and the connector knob clearance 121 that are shown in FIG. 8. The upper section is also provided with pads 113, each of which are part of a reclosable fastener set with matching pads 206 (Shown in FIG. 2) provided on the scoreboard 200. Such sets may conveniently involve a hook and loop design that are commonly sold under the Velcro name, although those with an interlocking mushroom-shaped head design sold under the Dual Lock name are used with some advantage in this particular application.

Figure 6A:
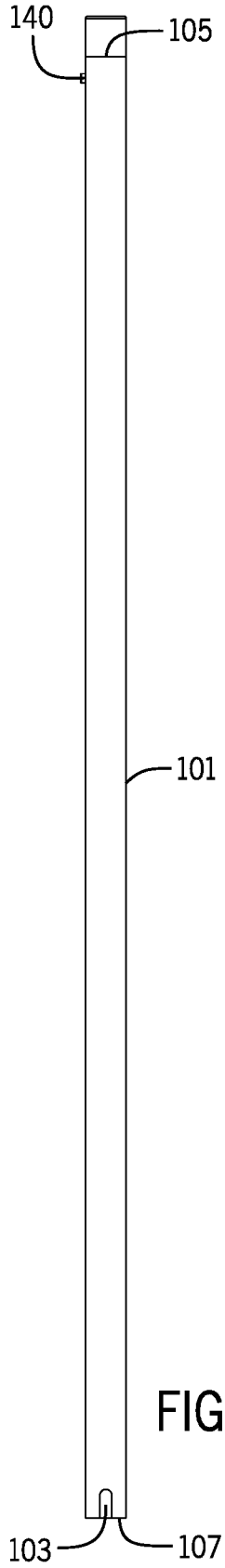
FIG. 6A is a perspective view of the upper portion of the upright member without its top cap.

FIG. 6A is an illustration of the upper section 101 without the cap 106 so that the aperture 140 that engages the snap button 111 of the cap 106 can be more clearly seen. This aperture and snap button structure facilitates the assembly of the scoring station 10 from a kit of modular components and its disassembly back to the component parts. It allows the cap 106 to be readily assembled to and removed from the upper section 101. This same aperture 140 facilitates an assembly involving the illumination sources illustrated in FIGS. 11 and 13.

FIG. 7 is an illustration of some of the features of the upright member cap 106. The cap 106 has a top portion 108, a step 109 and a bottom portion 110. The top portion 108 has outside dimensions that match the outside dimensions of the upper section 101 of the upright member 100 while the lower portion 110 has outside dimensions that match the inside dimensions of the upper section 101. The step 109 mates with the top edge 105 of the upper section 101. A snap button 111 resiliently projects through an aperture in a surface of the lower portion 110 of the cap 106 and is biased outward by a snap button spring 112. This same cap 106 can mate with the top of the lower section 104 when the lower section is a component of the beverage station 15.

FIG. 8 is an illustration of some of the features of the connector 114. It has an upper portion 116 whose outer dimensions match those of the inner dimensions of the upper section 101 such that it can be inserted into the open bottom end of the upper section 101. It also has a step 117 which mates with the bottom edge 107 of the upper section. The connector 114 is provided with a knob 120 which carries a threaded shaft 124 which engages a rivet nut 126 which has been affixed to the wall 127 of the connector 114 opposite the wall through which the threaded shaft 124 enters the interior of the connector 114. The end of the rivet nut 126 open to the exterior has been provided with an elastomeric membrane 122 such that as the knob 120 is rotated to cause its threaded shaft 124 to advance into the rivet nut 126 the membrane is caused to bulge out. The threaded shaft 124 is so dimensioned that when the upper portion 116 of the connector 114 is inserted into the lower end of the upper section 101 of the upright member 100 advancing the threaded shaft 124 into the rivet nut 126 will cause the elastomeric membrane to bulge into the inside of wall 127. At the same time this results in the clearance 121 between the knob 120 and the upper portion 116 of the connector 114 to be reduced to the thickness of the wall of the upper section 101 which carries the connection slot 103 shown in FIG. 6. The connection slot 103 (Shown in FIG. 6A) is dimensioned to accommodate the threaded shaft 124 when the upper portion 116 of the connector 114 passes into the lower end of the upper section 101 and its bottom edge 107 mates with the upper step 117 of the connector 114. The two point capture of the upper section 101 at the clearance 121 and the elastomeric membrane 122 provides a particularly secure connection and minimizes any play between the upper section 101 and the connector 114. The connector 114 is secured to the lower section 114 of the upright member 100 by rivets 128. The elastomeric membrane 122 may be prepared from silicone sealants such as Loctite Superflex 59330.

Figure 9:
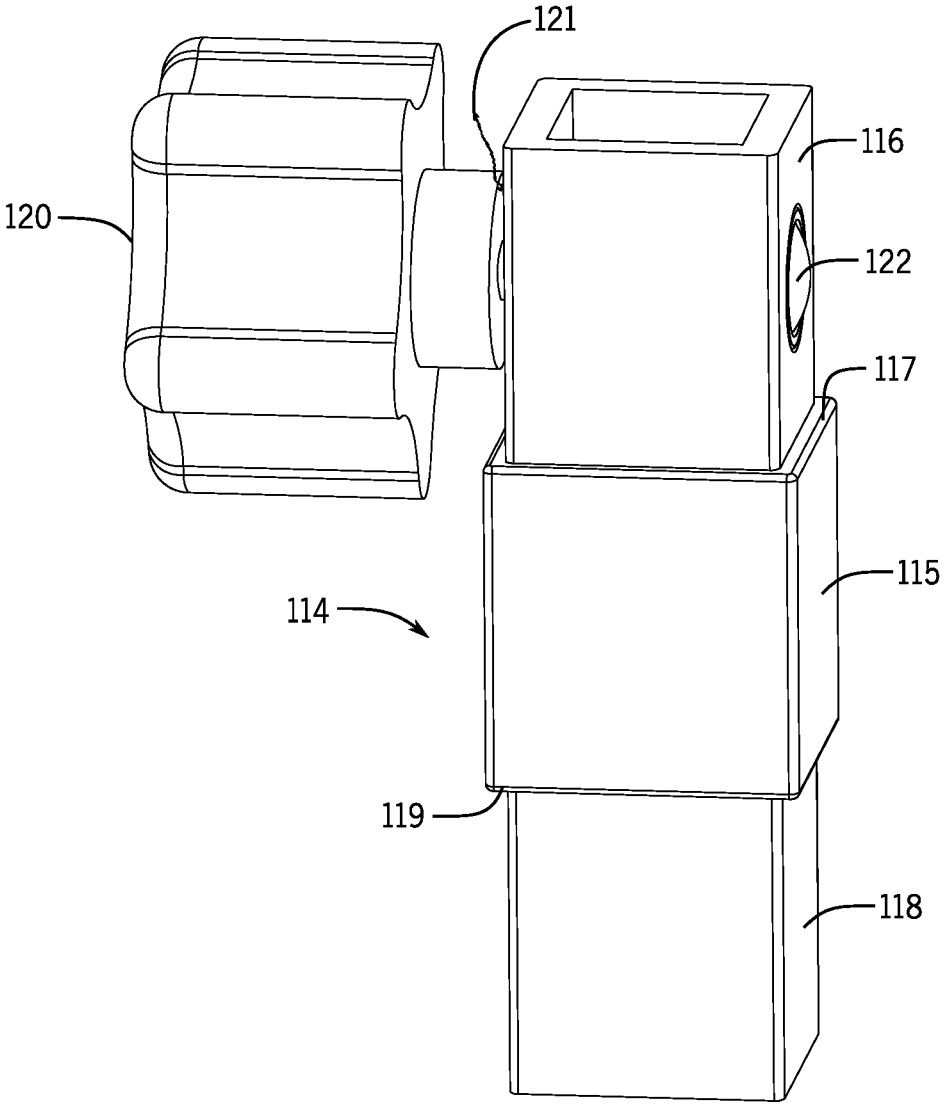
FIG. 9 is a prospective view of the connector alone.

FIG. 9 is a further illustration of the connector 114 showing its lower portion 118 whose outside dimensions match the inside dimensions of the lower section 104 of the upright member 100 such that the lower portion 118 can pass into the upper end of the lower section 104 with the lower step 119 of the connector 114 mating with upper edge 130 (Shown in FIG. 10) of the lower section 104 of the upright member 100.

Figure 10:
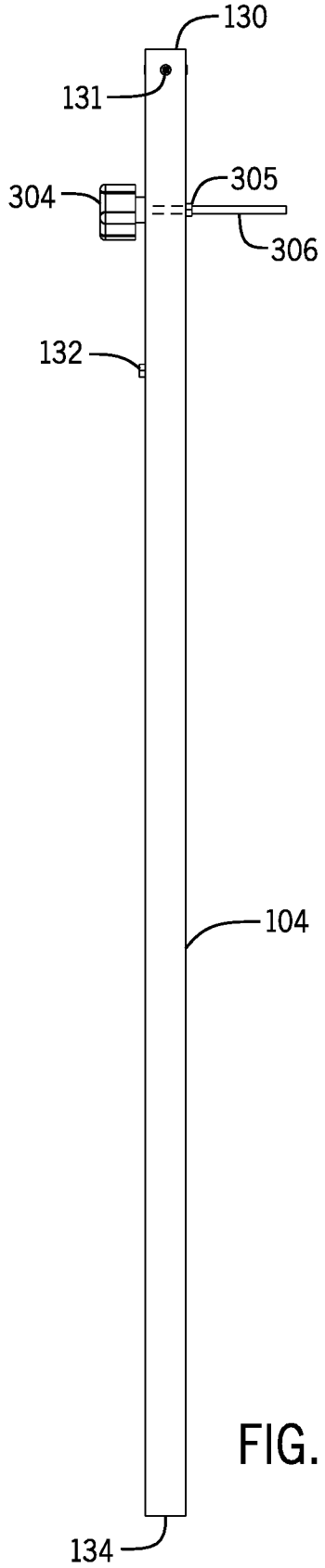
FIG. 10 is a prospective view of the lower section of the upright member of the scoring station that can also serve as the upright member of the beverage station.

FIG. 10 is an illustration of some of the features of the lower section 104 of the upright member 100. The lower section 104 has an upper edge 130 that mates with lower step 119 of the connector 114 (Both shown in FIG. 9). Also near the top of the lower section 104 is a snap button aperture 131 that is used to mate with the snap button 111 of the cap 106 (Both shown in FIG. 7) when the lower section 104 is employed as part of a beverage station 15. In that case the lower portion 110 of the cap 106 passes inside the lower section 104 and the upper edge 130 mates with the cap step 109. The lower section 104 additionally has a rivet nut 132 that accommodates the threaded shaft of the storage structure knob 404. The lower section 104 also carries a knob 304 that has a threaded shaft 306 that in turn carries a nylon lock washer 305. The threaded shaft 306 mates with a threaded insert 307 (shown in FIG. 3) that is a part of the beverage shelf structure 300 (also shown in FIG. 3). The nylon lock washer 305 acts to allow the threaded shaft 306 to rotate for engagement and disengagement of threaded insert 307, but prevents the threaded shaft 306 and its associated knob 304 from disengaging from the lower section 104. This prevents inadvertent loss of the knob 304. Lower section 104 has a lower edge 134 that interacts with the base limit screw 512 of base 500 (Both shown in FIG. 5) to limit how far the lower section 104 can penetrate into the base well 508. The nylon lock washer 305 may be replaced by any convenient retention device that allows the threaded shaft 306 to rotate but prevents the knob 304 from disengaging from the lower section 104.

Figure 11:
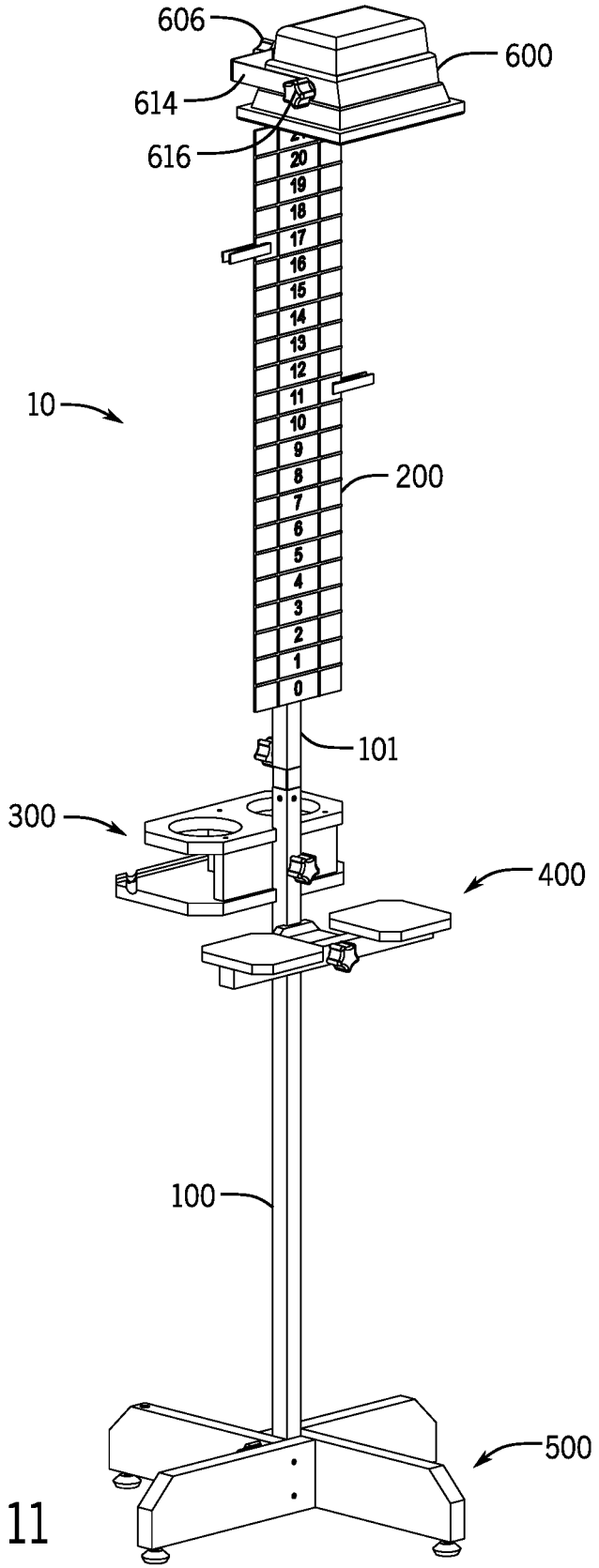
FIG. 11 is a prospective view of the scoring station with an LED illumination source affixed to the top of its upright member.

FIG. 11 is an illustration of a scoring station 10 that has been provided with an illumination source 600. This illumination source 600 is a LED fixture that is attached to the upright member 100 by an LED light source cap 606 and an LED light source bracket 614. The bracket 614 is provided with adjustment knobs 616. Otherwise this scoring station 10 is quite similar to that illustrated in FIG. 1 with a scoreboard 200, a beverage shelf structure 300, a storage structure 400 and a base 500.

Figure 12:
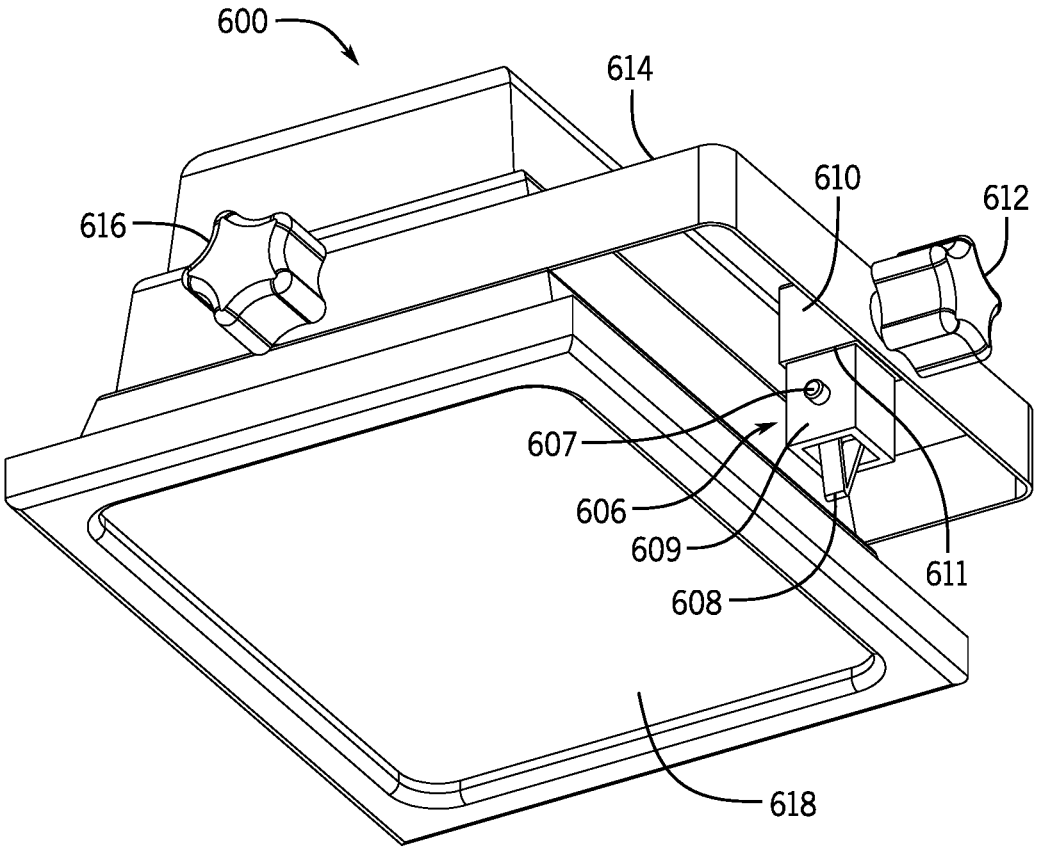
FIG. 12 is a prospective view of the LED illumination source adapted to be affixed to the top of the scoring station upright member.

FIG. 12 is an illustration of some of the features of the LED light source 600. The LED light source cap 606 is attached to the bracket 614 by the knob 612. The cap 606 is provided with a snap button 607 which mates with the aperture 140 in the top of the upper section 101 (Shown in FIG. 6A) of the upright member 100. The snap button 607 is biased outwardly by the snap button spring 608. The LED light source cap 606 interacts with the upper section 101 in a manner similar to the way the upright member cap 106 interacts with the upper section 101. Its lower section has outside dimensions that match the inside dimensions of the upper section 101 so that it can pass into the interior of the upper section 101. This LED light source cap 606 has an upper portion 610 with outside dimensions that match those of the upper section 101 and it has a step 611 which mates with the upper edge 105 of the upper section 101. The LED light source 600 has an aperture 618 which allows the light to be appropriately directed, for instance on the scoreboard 200 and the toss game apparatus, such as the slanted ramp used in corn hole or bags, and thus to avoid glare in the toss game players' eyes. The LED light source can either be powered by a battery, such as a rechargeable battery, or it can be provided with a power cord which plugs into an electrical receptacle. The LED light source 600 may conveniently provide between about 2700 to 3300 lumens that is well suited to illuminate the scoreboard 200 of the scoring station 10 which carries the light source 600 as well as the scoring site such as a corn hole board in the immediate vicinity of this scoring station 10. For play in limited light conditions making illumination desirable it is contemplated that a modified beverage station 15 that carries an illumination source 600 and lacks a scoreboard 200 would be disposed adjacent to the other scoring site, which in the case of a corn hole game would typically be a corn hole board with its front edge about 27 feet from the front edge of the first corn hole board.

Figure 13:
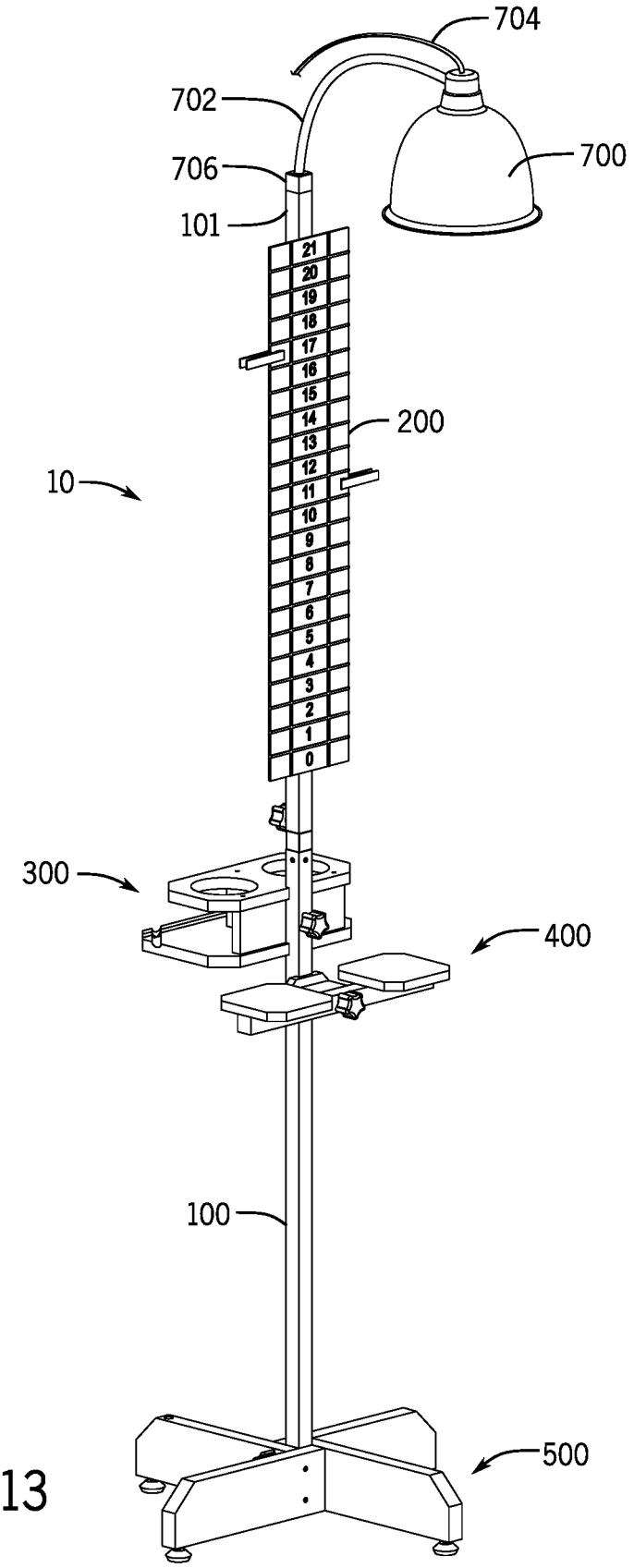
FIG. 13 is a prospective view of the scoring station with an incandescent illumination source affixed to the top of its upright member.

FIG. 13 is an illustration of a scoring station 10 that has been provided with an illumination source 700. This illumination source 700 is an incandescent lamp. The lamp 700 is carried by a flexible tube 702 commonly know as a goose neck which is attached to the upper section 101 of the upright member 100 by an incandescent light source cap 706. The lamp 700 is provided with a power cord 704 that plugs into an electrical receptacle. Otherwise this scoring station 10 is quite similar to that illustrated in FIG. 1 with a scoreboard 200, a beverage shelf structure 300, a storage structure 400 and a base 500.

Figure 14:
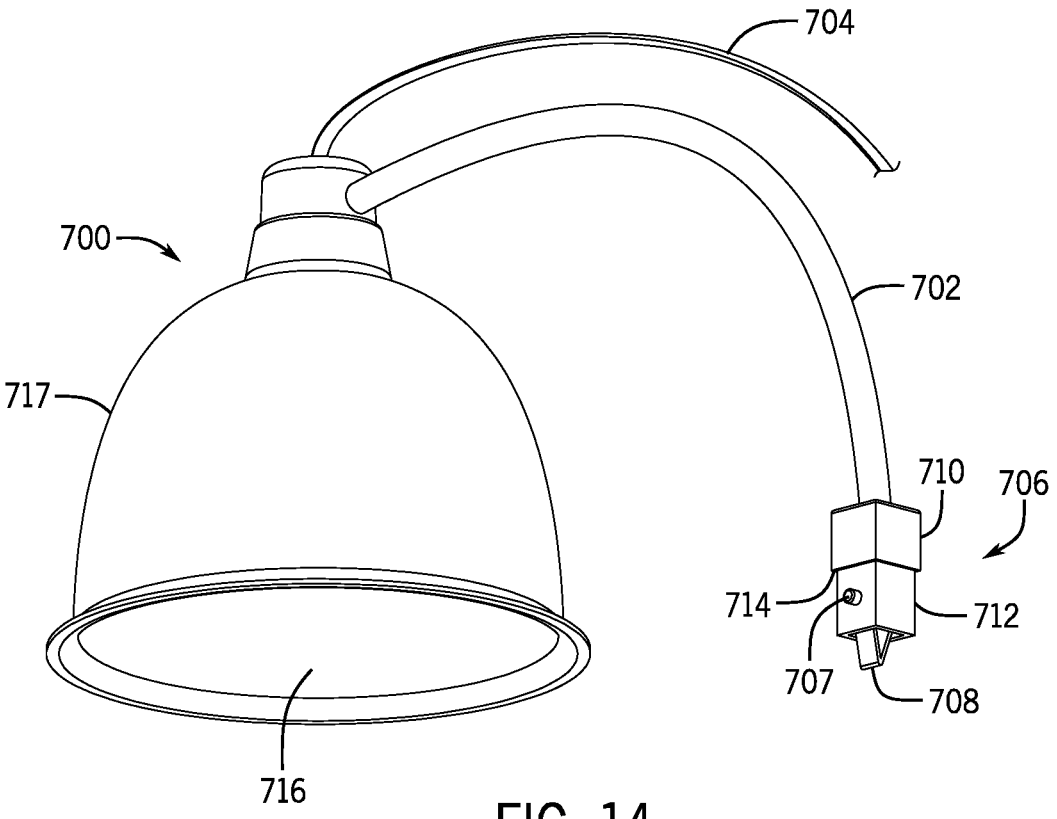
FIG. 14 is a prospective view of the incandescent illumination source adapted to be affixed to the top of the scoring station upright member.

FIG. 14 is an illustration of some of the features of the incandescent light source 700. The goose neck 702 is affixed to the incandescent light source cap 706. The cap 706 is provided with a snap button 707 which mates with the aperture 140 in the top of the upper section 101 (Shown in FIG. 6A) of the upright member 100. The snap button 707 is biased outwardly by the snap button spring 708. The incandescent light source cap 706 interacts with the upper section 101 in a manner similar to the way the upright member cap 106 interacts with the upper section 101. The cap has an upper portion 710 which has outside dimensions that match the outside dimensions of the upper section 101 of the upright member 100 and it has a lower portion 712 that has outside dimensions which match the inside dimensions of the upper section 101 such that the lower portion 712 can pass into the interior of the upper section 101. The step 714 of the cap 706 mates with the upper edge 105 of the upper section 101. The incandescent light source 700 has an aperture 716 which allows the light to be appropriately directed, for instance on the scoreboard 200 and the toss game apparatus, such as the slanted ramp used in corn hole or bags, and thus to avoid glare in the toss game players' eyes. The incandescent light source 700 typically comprises a bulb surrounded by an opaque shade 717.

The various components are designed so that they may be readily assembled into a scoring station 10 or a beverage station 15 and then disassembled back into a kit that can be placed in convenient packaging for transport. It is helpful if the assembly and disassembly can be readily effected without the use of tools and without the need to exert more force than is exerted in assembling typical household items like blender. The snap buttons and their associated apertures and the knobs and their associated threaded inserts or rivet nuts facilitate this ease of assembly and disassembly.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A multicomponent modular kit for assembling a scoring station for a toss game comprising:

a. an upright member with a vertical flat surface;

b. a scoreboard adapted to be repeatedly removably affixed to the upright member;

c. a shelf structure adapted to be repeatedly removably affixed to the upright member and to hold cylindrical beverage containers; and d. a base adapted to be repeatedly removably affixed to the lower section of the upright member to stably hold it in a vertical orientation when the scoreboard and shelf structure are affixed to the upright member and the base is placed on a hard essentially horizontal surface, wherein the scoreboard is affixed to the upright member with sets of reclosable fastener pads with one member of each of the sets being affixed to said flat surface of said upright member;

wherein the shelf structure comprises two vertically spaced apart parallel horizontal shelf members, each of which is essentially a flat sheet, with the upper member having cylindrical apertures that extend therethrough adapted to receive cylindrical beverage containers; and wherein when the shelf structure is affixed to the upright member the front edge of the lower shelf member extends beyond the front edge of the upper shelf member and the top surface of this extension carries a groove wide enough to accommodate the edge of a cell phone, and wherein the horizontal distance from the front edge of the upper shelf member to the groove and the vertical distance between the lower shelf member and the upper shelf member are such that if the bottom edge of the cell phone is placed in the groove it can be securely leaned against the front edge of the upper shelf member.

2. The kit of claim 1 wherein the upright member is rectangular in horizontal cross-section.

3. The kit of claim 1 further comprising a storage structure adapted to be repeatedly removably affixed to the upright member and providing two horizontal surfaces for the deposit of game pieces for the toss game.

4. The kit of claim 3 wherein either the upper or lower section has a flat vertical face adapted to facilitate affixing of the shelf structure and the storage structure.

5. The kit of claim 3 wherein the shelf structure, the storage structure and the base are each affixed to the upright member with a knob carrying a threaded shaft.

6. The kit of claim 1 wherein the base has leveling means to facilitate keeping the upright member in a vertical orientation when it is placed on a less than entirely horizontal surface.

7. The kit of claim 1 wherein the upright member comprises an upper section and a lower section adapted to be repeatedly removably rigidly joined to each other at a terminal end of each, the upper section and the lower section of the upright member each comprises a hollow tube with an inner wall and an outer wall, the upper section is connected to the lower section with a connector that fits inside both of them and is affixed to the upper section by a knob carrying a threaded shaft and the connector carries an elastomeric membrane that is bulged into frictional engagement with the inner wall of the upper section by the distal end of the threaded shaft of the knob.

8. The kit of claim 1 wherein the base comprises at least three arms that each extend horizontally from the point of connection with the upright member.

9. The kit of claim 8 wherein the arms comprising the base are attached to each other such that a cavity is formed that accommodates the bottom of the upright member.

10. The kit of claim 1 further comprising a fixture containing a light source that is adapted to be repeatedly removably affixed to the top of the upright member.

11. The kit of claim 10 wherein the top of the upright member is hollow with an aperture in its side and the fixture is adapted to be affixed to this member with a connector that fits within this member and carries a locking feature which is elastically biased to mate with this aperture when it is aligned with the aperture such that the connector can be disengaged from the upright member by exerting a mild upper ward force on the fixture.

12. The kit of claim 11 wherein the light source is an incandescent bulb that is surrounded by a shade and the fixture is adapted to be connected to the top of the upright member via a gooseneck arm.

13. The kit of claim 11 wherein the light source is an LED lamp and the fixture includes a swivel connection for adjusting the direction in which the light is emitted.

14. A multicomponent modular kit for assembling a beverage station for a toss game comprising:

a. an upright member;

b. a shelf structure adapted to be repeatedly removably affixed to the upright member and to hold cylindrical beverage containers; and c. a base adapted to be repeatedly removably affixed to the upright member to stably hold it in a vertical orientation when the shelf structure is affixed to the upright member and the base is placed on a hard essentially horizontal surface, the base having leveling means to facilitate keeping the upright member in a vertical orientation when it is placed on a less than entirely horizontal surface, wherein the shelf structure comprises two vertically spaced apart parallel horizontal shelf members, each of which is essentially a flat sheet, with the upper member having cylindrical apertures that extend therethrough adapted to receive cylindrical beverage containers; and wherein when the shelf structure is affixed to the upright member the front edge of the lower shelf member extends beyond the front edge of the upper shelf member and the top surface of this extension carries a groove wide enough to accommodate the edge of a cell phone, and wherein the horizontal distance from the front edge of the upper shelf member to the groove and the vertical distance between the lower shelf member and the upper shelf member are such that if the bottom edge of the cell phone is placed in the groove it can be securely leaned against the front edge of the upper shelf member.

15. A multicomponent modular kit for assembling a scoring station for a toss game comprising:

a. an upright member;

b. a scoreboard adapted to be repeatedly removably affixed to the upright member;

c. a shelf structure adapted to be repeatedly removably affixed to the upright member and to hold cylindrical beverage containers; and d. a base adapted to be repeatedly removably affixed to the lower section of the upright member to stably hold it in a vertical orientation when the scoreboard and shelf structure are affixed to the upright member and the base is placed on a hard essentially horizontal surface, e. a fixture containing a light source that is adapted to be repeatedly removably affixed to the top of the upright member, wherein the top of the upright member is hollow with an aperture in its side and the fixture is adapted to be affixed to this member with a connector that fits within this member and carries a locking feature which is elastically biased to mate with this aperture when it is aligned with the aperture such that the connector can be disengaged from the upright member by exerting a mild upper ward force on the fixture.

16. The kit of claim 15 wherein the light source is an incandescent bulb that is surrounded by a shade and the fixture is adapted to be connected to the top of the upright member via a gooseneck arm.

17. The kit of claim 15 wherein the light source is an LED lamp and the fixture includes a swivel connection for adjusting the direction in which the light is emitted.

* * * * *